US006195016B1

(12) United States Patent
Shankle et al.

(10) Patent No.: US 6,195,016 B1
(45) **Date of Patent: *Feb. 27, 2001**

(54) FIBER OPTIC DISPLAY SYSTEM WITH ENHANCED LIGHT EFFICIENCY

(75) Inventors: Matthew W. Shankle, Denver, CO (US); Gregory L. Heacock, Camas; Steven J. Shankle, Redmond, both of WA (US)

(73) Assignee: Advance Display Technologies, Inc., Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/384,652

(22) Filed: Aug. 27, 1999

(51) Int. Cl.[7] ..... G08B 5/00; G09G 3/00

(52) U.S. Cl. ..... 340/815.42; 340/815.47; 340/815.55; 340/815.76; 345/30; 345/31; 345/32; 345/77; 345/2; 345/3; 345/102; 345/20; 362/800; 359/173; 348/359; 348/366; 348/801; 385/115; 385/116

(58) Field of Search ..... 340/815.4, 815.41, 340/815.76, 815.47, 815.42, 815.55; 362/803; 345/2, 3, 20, 31, 32, 30, 102, 108, 109, 77; 359/32, 33, 34, 172, 173; 348/222, 227, 359, 360, 366, 740, 801; 40/547, 564; 385/115, 116, 119, 147, 901; 349/57

(56) References Cited

U.S. PATENT DOCUMENTS

| | | | | |
|---|---|---|---|---|
| 3,909,109 | | 9/1975 | Aurenz | 395/116 |
| 4,116,739 | | 9/1978 | Glenn | 156/169 |
| 4,417,412 | * | 11/1983 | Sansom | 40/547 |
| 4,525,711 | * | 6/1985 | Gery | 340/815.31 |
| 4,650,280 | | 3/1987 | Sedlmayr | 385/120 |
| 4,720,165 | | 1/1988 | Tokuda et al. | 156/166 |
| 4,738,510 | | 4/1988 | Sansom | 385/116 |
| 4,762,392 | | 8/1988 | Yamamoto et al. | 385/141 |
| 4,773,730 | | 9/1988 | Sedlmayr | 385/137 |
| 4,786,139 | | 11/1988 | Sedlmayr | 385/120 |
| 4,812,012 | | 3/1989 | Terada et al. | 385/115 |
| 4,815,807 | | 3/1989 | Kaneko et al. | 385/33 |
| 4,865,417 | | 9/1989 | Naohiro et al. | 385/123 |
| 4,867,530 | | 9/1989 | Sedlmayr | 385/176 |
| 4,917,448 | | 4/1990 | Oppenheimer | 385/116 |
| 4,929,048 | | 5/1990 | Cuypers | 385/116 |
| 4,950,357 | | 8/1990 | Sedlmayr | 156/426 |
| 4,973,128 | * | 11/1990 | Hodges | 359/41 |
| 5,009,475 | | 4/1991 | Knudson | 385/133 |
| 5,013,110 | | 5/1991 | Marazzi | 385/77 |
| 5,058,989 | | 10/1991 | Sakunaga et al. | 359/455 |
| 5,129,032 | | 7/1992 | Kawai et al. | 385/76 |
| 5,247,600 | * | 9/1993 | Williams et al. | 385/15 |

(List continued on next page.)

*Primary Examiner*—Donnie L. Crosland
(74) *Attorney, Agent, or Firm*—McAndrews, Held & Malloy, Ltd.

(57) ABSTRACT

A fiber optic display sign has an optical system with enhanced light efficiency so that the display system is suitable for outdoor use. A number of fiber optics have light receiving ends arranged in a compact bundle for receiving an image from an image generator, the fiber optics coupling the image to the output ends thereof for display. An array of lenses is positioned adjacent the output ends of the fiber optics for directing or aiming the light from the fiber optics to control the viewing angle of the image displayed. The array of lenses may be fixed with respect to the output ends of the fiber optics or the lens array may be movable with respect thereto so as to vary the viewing angle. The image generator employs a light source formed of a densely packed array of white light emitting diodes to provide enhanced brightness. The image generator includes a number of image bearing transparencies mounted on a movable support that is controlled to position a selected transparency between the light source and the light receiving ends of the fiber optics for display. The viewing angle and/or the image displayed is automatically controlled and/or remotely controlled.

64 Claims, 3 Drawing Sheets

U.S. PATENT DOCUMENTS

| | | | | |
|---|---|---|---|---|
| 5,293,437 | | 3/1994 | Nixon | 362/554 |
| 5,376,201 | | 12/1994 | Kingstone | 156/250 |
| 5,504,598 | * | 4/1996 | Sprague et al. | 359/41 |
| 5,668,913 | | 9/1997 | Tai et al. | 362/31 |
| 5,739,931 | | 4/1998 | Zimmerman et al. | 349/57 |
| 5,832,168 | | 11/1998 | Yenter | 385/116 |
| 5,905,826 | * | 5/1999 | Benson, Jr. et al. | 385/31 |
| 6,023,869 | * | 2/2000 | Durbin | 40/544 |

* cited by examiner

FIBER OPTIC DISPLAY SYSTEM WITH ENHANCED LIGHT EFFICIENCY

CROSS-REFERENCE TO RELATED APPLICATIONS

N/A

STATEMENT REGARDING FEDERALLY SPONSORED RESEARCH OR DEVELOPMENT

N/A

TECHNICAL FIELD

The present invention is directed to a fiber optic display system and more particularly to a fiber optic display system with enhanced light efficiency that is suitable for traffic signs or the like used outdoors.

BACKGROUND OF THE INVENTION

Large fiber optic displays are known in which the light receiving ends of the fiber optics are arranged in a bundle adjacent a small LCD display to pick up the image displayed thereon. The fiber optics couple the image to the light output ends of the fibers to display an enlarged image. The image output from the fiber optics is enlarged by spacing the light output ends of the fiber optics farther apart than the spacing between the light receiving ends of the fiber optics. Such fiber optic displays are difficult to use outdoors in bright light conditions because they are very light inefficient. For example, only approximately 2% of the backlight typically passes through a LCD panel. In order to control the viewing angle of the displayed images, the output ends of the fiber optics in some known displays have been cut at a very sharp angle. However, these types of fiber optic displays have problems with unwanted reflections of light back into the fibers. Another known fiber optic display employs a diffusion face plate spaced a distance from the fiber optic output ends. The diffusion plate spreads the light output from the fiber optics. However, because a diffusion plate does not aim or direct the light but randomly scatters light, it is not light efficient and further reduces the light output of the display. Moreover, the back light for the input image generator is typically a single element bulb so as to provide a uniformly illuminated input image. However, given the light inefficiencies of known fiber optic display systems, it is difficult to find a backlight with sufficient brightness to allow the fiber optic display to be used outdoors in ambient light conditions.

BRIEF SUMMARY OF THE INVENTION

In accordance with the present invention, prior fiber optic display systems have been overcome. The fiber optic display system of the present invention utilizes optical elements that increase the light efficiency and the light throughput of the fiber optic display so that it is suitable for use outdoors.

More particularly, the fiber optic display system of the present invention includes a plurality of fiber optics having first and second ends, the first ends being arranged in a bundle to receive an image. The fiber optics couple the received image to the second ends thereof for displaying the image where the spacing between the second ends of the fibers is greater than the spacing between the first ends of the fibers. The display system also includes a light source and an image generator disposed between the light source and the first ends of the fiber optics to generate an image that is focused on the first ends of the fiber optics. In accordance with the present invention, an array of lenses is positioned adjacent the second ends of the fiber optics for receiving light therefrom wherein the lenses aim the light output from the fiber optics to control the viewing angle of the image displayed. The lens array of the present invention substantially eliminates unwanted reflections back into the fiber optics and is extremely light efficient. Moreover, the position of the lens array with respect to the second or output ends of the fiber optics can be controlled to provide a desired viewing angle of the image displayed.

In one embodiment of the present invention, the lens array is formed as a panel of microlenses. In this embodiment, the array is movable with respect to the output ends of the fiber optics to vary the viewing angle of the image displayed. The position of the lens array is automatically controlled in accordance with data stored in a computer control unit of the display system. The display system includes a communication interface such as a modem or a wireless communication interface coupled to the system's computer control unit to allow the positioning of the lens array to be remotely controlled.

In a second embodiment of the present invention, a panel that supports the second or output ends of the fiber optics also supports an individual lens in association with each fiber optic. The positioning of the lens with respect to a fixed aperture associated with the fiber optic output end controls the viewing angle of the displayed image. Moreover, by utilizing a prismatic lens, the image may be directed to a particular location. When the fiber optic display is utilized to display traffic sign information, the prismatic lens can direct the image to a particular lane of traffic and to a particular location so that the image is seen by only the vehicle drivers to whom the information is directed.

To further increase the brightness of the fiber optic display, a light source is employed that is formed of a densely packed array of white light emitting diodes. In one embodiment, the light emitting diodes are mounted on one or more walls of a white interior illumination box. The light from the illumination box passes through a brightness enhancing film to a frosted plate so as to produce extremely bright but uniform white light illumination.

In accordance with another feature of the present invention, the fiber optic display system includes one or more "monitoring" fiber optics having an end supported in the output display panel for receiving ambient light. These "monitoring" fiber optics couple received ambient light to a photo detector that is in turn coupled to a controller. Based on the intensity of the ambient light as determined by the photo detector, the controller varies the brightness of the illumination source. Under bright ambient light conditions, such as daylight, the controller increases the brightness of the illumination source; whereas at night, the brightness of the illumination source can be decreased. Moreover, the detected light intensity can be monitored to determine if the face of the fiber optic display is dirty. This information can then be transmitted via the communication interface to a remote location so as to provide notice that the display needs cleaning.

In accordance with a further feature of the present invention, the input image generator includes a number of image bearing transparencies on a movable support. A motor is coupled to the transparency support and controlled to move the support to position a selected image bearing transparency between the light source and the first or input ends of the fiber optics so as to display the image depicted on the selected transparency. Each of the image bearing transparencies is accompanied by position indicia that is detected so as to provide position feedback and/or registration information for the controller. The controller is programmed to display selected images in a particular sequence and/or at particular times during the day. Moreover, the controller can receive information from a remote location to change the image displayed or the sequence of images displayed. The image generator of the present invention is extremely simple and robust but allows great flexibility so that different images can be depicted on the fiber optic display.

These and other advantages and novel features of the present invention, as well as details of an illustrated embodiment thereof, will be more fully understood from the following description and drawings.

DETAILED DESCRIPTION OF THE INVENTION

Figure 1:
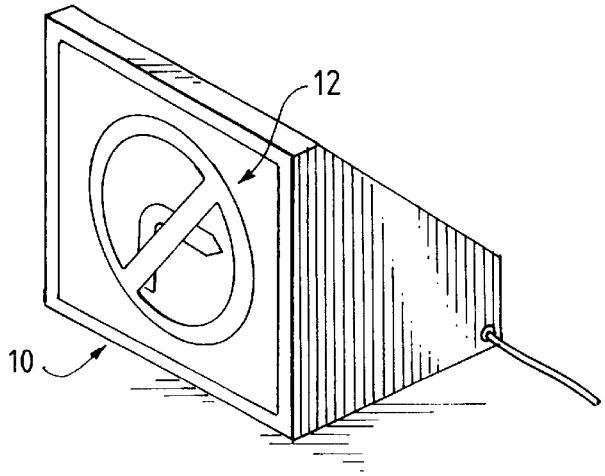
FIG. 1 is a perspective view of a fiber optic display in accordance with the present invention.

The fiber optic display system 10 of the present invention as shown in FIG. 1 displays a large color image 12 of enhanced brightness so as to be suitable for outdoor use and in particular, for use as a traffic sign. As discussed in detail below, the display 10 can display any one of a number of images. A number of images can be displayed in a predetermined sequence or at particular times during the day. For example, the traffic sign can display a message in a sequence of different languages or the sign can display a series of messages in a particular sequence. Moreover, the image or images selected for display can be changed and/or remotely controlled. Thus, if an accident occurs down the road from the sign, the sign can be remotely controlled to periodically display a warning message instead of or in addition to the message the signal typically displays. Further, for a speed limit sign, the speed limit displayed can be remotely changed in accordance with weather and/or road conditions. Thus, the fiber optic display system of the present invention provides an extremely flexible outdoor sign.

Figure 2:
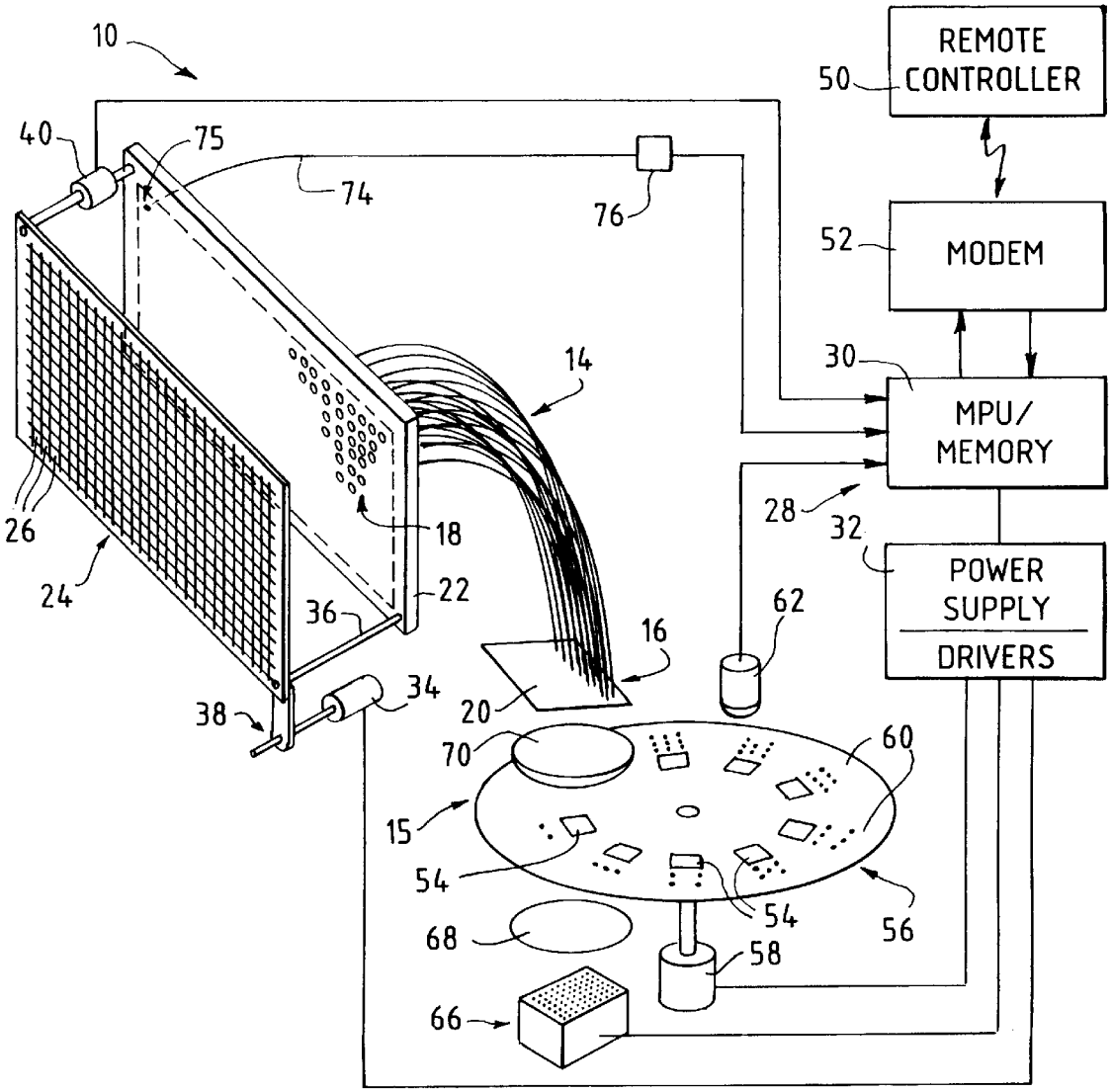
FIG. 2 is a block diagram illustrating one embodiment of the fiber optic display system of the present invention utilizing a microlens array that is movable with respect to the fiber optic output panel.

As shown in FIG. 2, the fiber optic display system 10 includes a large number of fiber optics 14. The fiber optics have light receiving ends 16 arranged to receive an image from an image generating system 15 as discussed in detail below. The image picked up by the fiber ends 16 is coupled by the fiber optics 14 to light output ends 18 for display. A fiber optic input panel 20 supports the light receiving ends 16 of the fiber optics 14 in a compact bundle; whereas a fiber optic output panel 22 supports the light output ends 18 of the fibers 14. The spacing between the fiber ends 18 supported in the panel 22 is greater than the spacing between the light receiving ends 16 supported in the panel 20 to generate an enlarged image at the output 18 of the fiber optics. The position of the fiber ends 16 in the input panel 20 is correlated with the position of the fiber ends 18 in the output panel 22 so that the segment of the image picked up by each of the input fiber ends 16 is displayed in the corresponding, correct position at the fiber optic output panel 22. Preferably, the fiber optics employed are plastic optical fibers such as PMMA fiber optics. As an example, the size of the fiber optic input panel 20 is on the order of 57 mm square whereas the fiber optic output panel 22 is on the order of 450 mm square with a 6 mm pixel pitch and fiber diameter of 0.75 mm. Obviously, the size of the input panel and output panel can vary as well as the fiber diameter and spacing. Further, it should be appreciated that fiber optics other than plastic fibers can be used as well.

The fiber optic display system 10 in accordance with the present invention includes an array of lenses for aiming the light output from the fibers so as to control the exit angle of the light or viewing angle of the displayed image. In a first embodiment as shown in FIG. 2, the array of lenses is in the form of a plate or panel 24 of lenses 26. Preferably, the lenses 26 are microlenses embossed on a sheet of plastic. The light output from one fiber optic 14 is picked up by one or more adjacent microlenses that collect and aim the light to control the viewing angle. The viewing angle is controlled so that a viewer of the display 10 has to be in a particular position relative to the display in order to view the image. As such, although the display 10 may be widely seen, the image depicted thereon can be directed to viewers in a particular location. Thus, for a traffic sign, the message can be directed to vehicle drivers in a particular lane of traffic as opposed to all of the lanes.

Preferably, the lens array 24 is movable with respect to the fiber optic output panel 22 so that the viewing angle can be automatically changed by a controller 28. The controller 28 includes a computer control unit 30 with a microprocessor or CPU and associated memory. The controller 28 also includes a power supply and driver generally designated 32 that is coupled between the computer control unit 30 and one or more motors such as the servo motor 34. The servo motor 34 is responsive to control signals coupled from the computer control unit 30 via the driver unit 32 to slide the lens array 24 towards or away from the fiber output panel 22. The lens array panel 24 slides on one or more pins 36 wherein the motor 34 is coupled to the lens array panel 24 via a lead screw 38 or the like.

A position sensor 40 provides feedback information to the computer control unit 30 regarding the current position of the lens array panel 24 with respect to the fiber optic panel 22. It is noted however, depending upon the type of motor 34 utilized and the information stored in the computer control unit, a position sensor 40 might not be necessary. The computer control unit 30 is responsive to data representing the current position of the lens array panel 24 with respect to the fiber optic panel 22 to provide position control signals to the motor 34 via the driver unit 32 so as to position the lens array 24 to provide a desired viewing angle. The computer control unit 30 automatically changes the position of the lens array 24 with respect to the fiber optic plate 22 in accordance with data stored in its memory and/or in accordance with information received from a remote controller 50. For example, when displaying one selected image, one viewing angle may be used to direct the message to a first location. However, a different message can be directed to a different location by changing the position of the lens array and the viewing angle. Thus, the viewing angle can be controlled to change when different messages are displayed.

Preferably, the fiber optic display system 10 includes a communication interface such as a modem 52 or a wireless communication interface so as to receive data from a remote controller 50 and/or to send status information to the remote controller 50. Thus, the viewing angle of the fiber optic display system 10 can be remotely controlled as well as the image 12 or images selected for display as discussed below.

The image generator system 15 allows one of a number of predetermined images to be depicted on the fiber optic display 10. In particular, the image generator includes a number of image bearing transparencies 54 on a movable support 56. The transparencies are preferably formed of a glass plate or the like with a transparent color image printed thereon. The movable support as shown in FIG. 2 is in the form of a disk with the transparencies 54 arranged about a circle on the disk. It should be appreciated however that the support can take forms other than a disk (for example, a rotatable drum) as long as the support can be moved to select a particular image for display. The disk 56 is rotatable by a motor such as the servo motor 58 that is controlled by the computer control unit 30 via the power supply and driver unit 32. Each image bearing transparency 54 has position or registration indicia 60 associated therewith to uniquely identify the transparency. The position indicia 60 is detected by an indicia detector 62 that is in a known position with respect to the display position of a selected image, i.e. the position of a selected transparency between the light source 66 and the fiber optic panel 20. The indicia detector 62 decodes the indicia into digital information which is provided to the computer control unit 30. It is noted that, the indicia 60 and indicia detector 62 can be any of a well-known number of types. For example, the indicia might be in the form of a barcode and the indicia detector 62 can be a barcode scanner or the like.

The computer control unit 30, in response to position information received from the indicia detector 62 controls the motor 58 to position a selected image bearing transparency 54 between a light source 66 and the fiber optic input panel 20. A lens 68 gathers the light from the source 66 and concentrates the light on the selected image bearing transparency 54 so as to project the image borne on the transparency 54 to the input ends 16 of the fiber optics 14. A lens 70 disposed between the selected image bearing transparency 54 and the fiber optic input panel 20 focuses the image on the input ends 16 of the fiber optics 14 for display at the output 18 of the fibers. The computer control 30 controls the motor 58 to position selected ones of the transparencies 54 in a desired sequence as determined by data stored in the computer control unit's memory. The memory of the computer control unit 30 storing the identity of the sequence of images to be displayed is preferably electronically programmable so as to be updated or changed by data received from the remote controller 50. Although the content of the images depicted on each of the transparencies 54 is fixed, the movable support 56 can support a sufficient number of transparencies with different images thereon so as to display different messages on the display 10 depending on various circumstances.

It is noted that an emissive light display may also be used as the image generating system 15. In this embodiment, the computer control unit 30 directly controls the image, pictorial and/or text, generated wherein the images are not fixed or limited to a predetermined number.

The computer control unit 30 also transmits maintenance and/or status information to the remote controller 50 regarding the operation of the fiber optic display 10. For example, one or more "monitoring" fiber optics 74 are employed to pick up ambient light the intensity of which is detected by a photo detector such as a photo diode 76. Preferably, an end 75 of the fiber optic 74 is supported in the output panel to receive ambient light. The photo detector 76 detects the intensity of the received light and generates a signal representative thereof that is coupled to the computer control unit 30. The computer control unit 30 is responsive to the intensity of the ambient light to control the intensity of the light source 66. The brighter the ambient light, the greater the intensity of the light source. Therefore, in response to the intensity of the ambient light as detected by the photo detector 76, the computer control unit 30 via the power supply unit 32 varies the brightness of the light source 66. The intensity of the light picked up by the monitoring fiber 74 is also used to determine whether there has been dirt build-up on the exterior surface of the display 10. If the computer control unit 30 determines from monitoring the intensity of the ambient light over a given period of time that the display 10 needs to be cleaned, the controller 30 transmits status information to the remote controller 50 so that the fiber optic display system can be properly maintained. It is noted that the status information can be retrieved or sent to the remote computer whenever desired.

Figure 3:
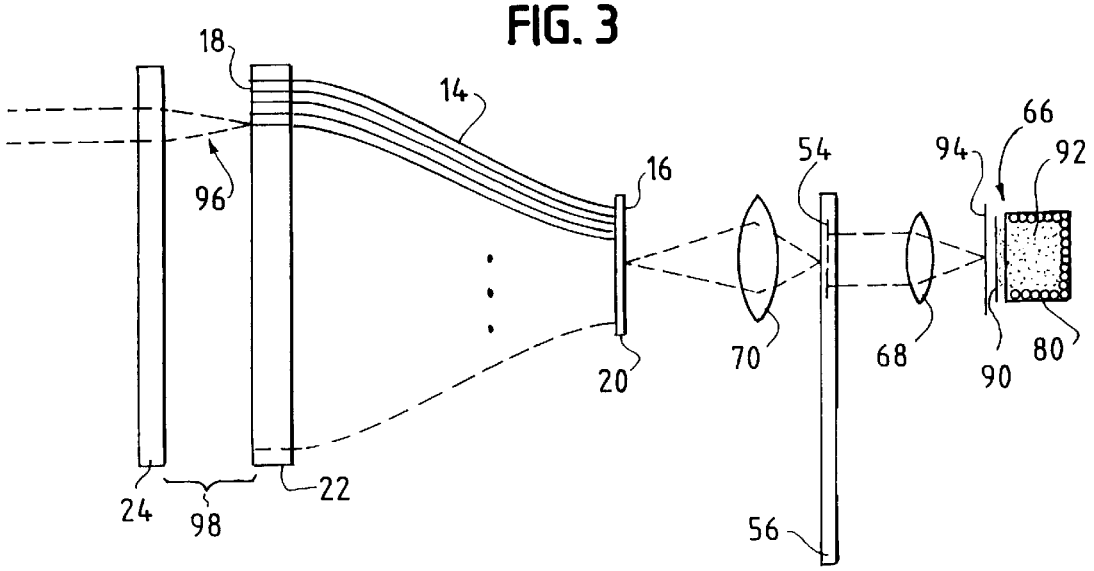
FIG. 3 is a ray tracing illustrating the optics of the fiber optic display system of FIG. 2.
Figure 5:
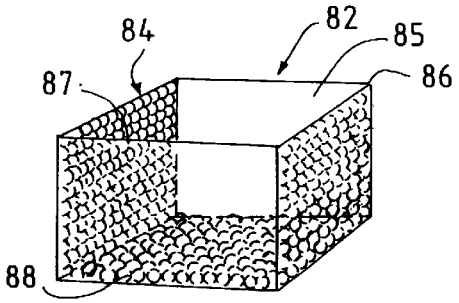
FIG. 5 is a perspective view of a preferred embodiment of a light source used with the image generator of the fiber optic display system.

The optical system of the fiber optic display 10 of the present invention is illustrated in FIG. 3. As shown therein, the light source 66 preferably includes an array of densely packed white light emitting diodes (LEDs). In a preferred embodiment as shown in FIG. 5, the array of LEDs are mounted on one or more inner surfaces of a box 82 having a white interior for reflecting light therein. In one embodiment, the LEDs are mounted on the inner surfaces of the four side walls 84–87 and the bottom wall 88 of the box 82. As an example, 120 LEDs are mounted on each 65 mm square wall. However, it should be appreciated that the number of LEDs and size of the walls can vary. Further, the LEDs can be mounted on a reduced number of the interior side walls and/or the bottom wall 88. The white surface of the interior of the box 82 wherever an LED is not mounted reflects the white light from the LEDs to provide an extremely bright light source. A brightness enhancing film 90 such as made by the 3M Company is positioned in front of the opening 92 of the box 82 adjacent the top of the side walls 84–87 to further enhance or increase the brightness of the light source. A frosted glass plate 94 is positioned in front of the brightness enhancing film. Through multiple reflections of the light within the white box 82, the use of multiple LEDs and the brightness enhancing film 90, the box 82 acts as a light integrator which, when used in conjunction with the frosted glass plate 94 produces even or uniform white illumination light. If one or even multiple LEDs go out, the light source 66 is still operational because the reflection of the light within the box 82 will mask out the non-operational LEDs. Further, the computer control unit 30 monitors the status of the light source 66 to determine if a predetermined number of LEDs are non-operational so as to indicate that the light source 66 needs to be replaced. If a predetermined number of LEDs are non-operational, the computer control unit sends an indication thereof to the remote controller 50 in a status message.

Figure 4:
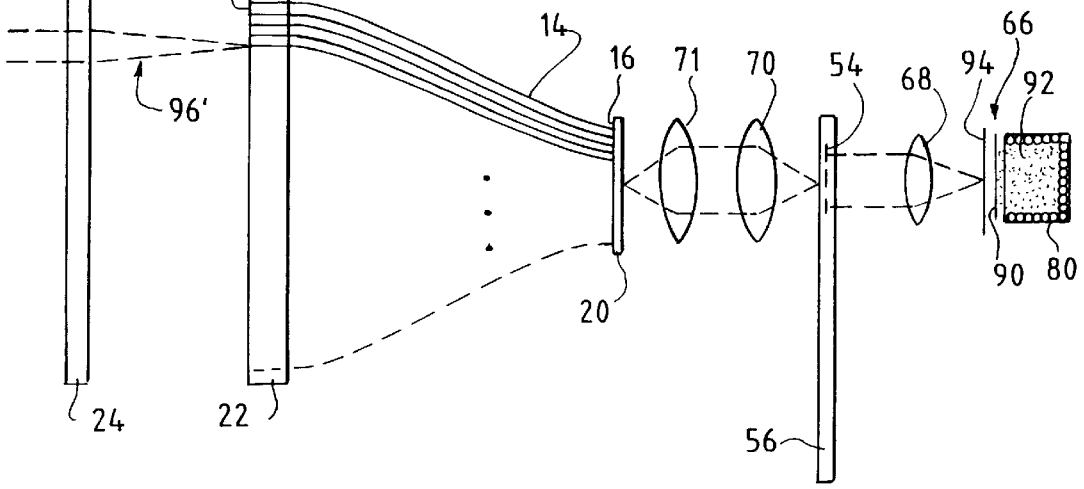
FIG. 4 is a ray tracing illustrating the optics of the fiber optic display system of FIG. 2 with the lens array moved a greater distance from the fiber optic output panel than as shown in FIG. 3.

A spherical lens 68 has a focal length of approximately 30 mm to collimate the light at any point on the plate 94 to direct the light to the back of the image bearing transparency 54. Any point on the transparency 54 is focused on the fiber optic input plate 20 by the lens 70. The fiber optics 14 couple the image received by the input ends thereof to the output ends 18 of the fibers. The image at the output of each fiber end 18 diverges as shown by rays 96 until the rays intersect the lens array 24. Each of the microlenses of the array 24 has a focal length of 3 to 35 mm and acts to collect the light and direct it to a viewer in a particular viewing area. By changing the spacing between the lens array 24 and the fiber optic output panel 22, the viewing angle presented to the viewer is correspondingly changed. For example, if the lens array 24 is composed of lenses each having a focal length of 10 mm with the lens array 24 located 10 mm from the fiber optic output panel 22, shown by the spacing 98 in FIG. 3, the resulting viewing angle will be narrow with concentrated brightness, much like a flashlight beam. If the lens array 24 is moved farther from the fiber optic output panel 22 as shown in FIG. 4, the image viewing angle will be expanded as the light output from the fiber ends 18 diverges as shown by the rays 96' until the rays intersect the lens array 24. In this case, a diverging viewing angle is produced, similar to the light from a lantern which has a much greater viewing angle than the light from a flashlight. It is noted that the use of microlenses in an array that moves is advantageous because there is not a one to one association between a microlens and a fiber optic. As the array 24 moves farther from the panel 22, a given microlens will receive light from more fibers. In other embodiments that utilize a lens array wherein each fiber has a particular, associated lens, that relationship should be maintained as the lens array 24 is moved. It is further noted, that multiple lenses may be used to focus the image borne on the transparency 54 onto the ends 16 of the fiber optic input panel 20 such as shown by lens 70 and lens 71 in FIG. 4.

Figure 6:
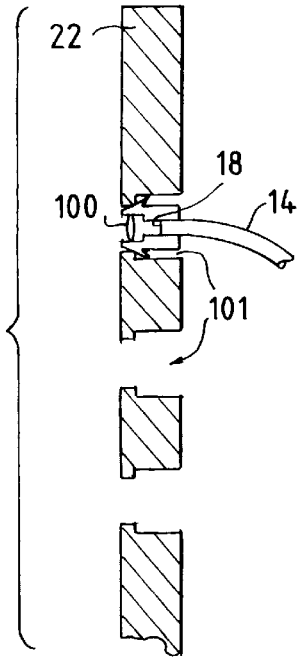
FIG. 6 is a cross-sectional view of the fiber optic output panel in accordance with a second embodiment of the present invention with an individual lens associated with each fiber optic output end used for the display.
Figure 7:
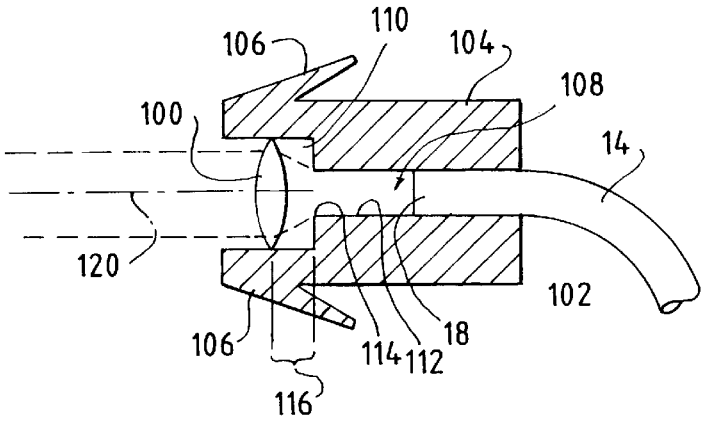
FIG. 7 is a cross-sectional view of a fiber optic end and lens support member to control the exit angle of the light from the display.
Figure 9:
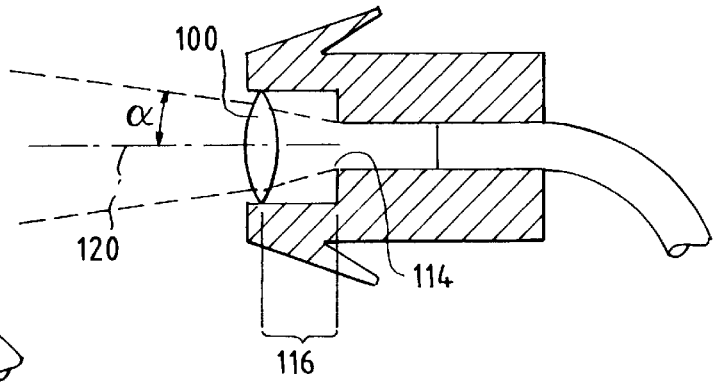
FIG. 9 is a cross-sectional view of the fiber optic end and lens support member with the lens moved a greater distance from a fixed aperture associated with the fiber end than as shown in FIG. 7 so as to diverge the light output from the lens.
Figure 8:
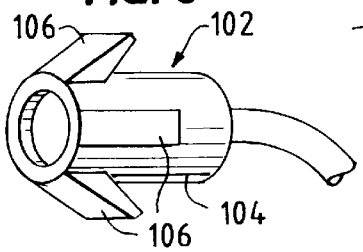
FIG. 8 is a perspective view of the fiber optic end and lens support member of FIG. 7.
Figure 10:
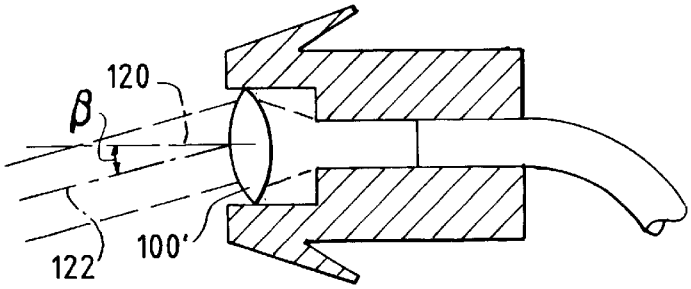
FIG. 10 is a cross-sectional view of the fiber end and lens support member illustrating the effect of utilizing a prismatic lens.

In an alternative embodiment, instead of a movable lens array 24, or in addition thereto, each fiber optic end 18 for displaying the image has an associated lens 100. As shown in FIG. 6, the fiber optic output panel 22 has a number of apertures 101 therein and in which the fiber optic output end 18 and the lens 100 are supported. Although the fiber optic end 18 and the lens 100 can be directly mounted in the aperture 101 of the panel 22, preferably, the fiber end 18 and lens 100 are mounted in a focus mounting member 102 which is inserted into an aperture 101 of the panel 22. The mounting member 102 for the fiber end 18 and associated lens 100 as shown in FIGS. 7 and 8 includes a cylindrical body 104 with a number of arms 106 extending outwardly from an upper peripheral surface of the body 104. When the member 104 is inserted into an aperture 101 of the fiber optic output panel 22, the arms 106 are pushed inward, locking the member 104 in the aperture 101 of the panel 22. The member 104 includes a first aperture 108 into which the end 18 of a fiber optic is inserted. The aperture 108 leads into a larger aperture 110 in which is mounted the lens 100. Light exiting the end 18 of the fiber optic 14 is blocked by the wall 112 defining the aperture 108. The shoulder 114 of the wall 112 acts like a fixed optical aperture so that it does not matter how far the end 18 of the fiber optic extends into the aperture 108. The optical aperture at 114 remains the same. The projection of light from the fixed aperture 114 is collected by the lens 100. The lens 100 can be a spherical lens having a focal length of 3 to 8 mm. With the lens 100 positioned in the member 104 at a distance 116 approximately equal to one focal length from the fixed aperture 114, the light exiting the lens 100 is nearly parallel with respect to the optical center line 120 of the lens 100. If the lens 100 is moved farther from the fixed aperture 114, as shown in FIG. 9, so that the distance 116 is greater than one focal length of the lens 100, the angle $\alpha$ of the exiting light becomes diverging relative to the optical center line 120. In order to direct the exiting light in a particular direction, i.e. to the right or to the left, etc., the lens 100' is formed as a prismatic lens as shown in FIG. 10. With the prismatic lens 100, the center line of the illumination 122 is tilted by an angle $\beta$ with respect to the normal center line 120.

Figure 11:
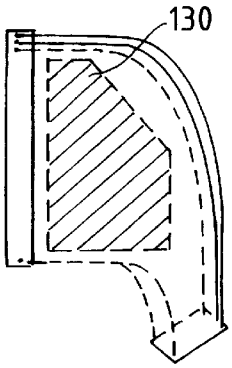
FIG. 11 is a cross-sectional view of the fiber optics supported in an expanded polyurethane foam material so as to provide a structurally robust fiber optic display system.

After inserting the fiber ends 18 and 16 into the respective input and output panels 20 and 22, in order to form an extremely robust display system, polyurethane foam 130, as shown in FIG. 11, is inserted into a mold surrounding the fibers. The polyurethane foam flows around the fibers and expands as it sets, separating the fibers so that they do not rub together scratching each other. The foam provides a fiber optic structure that can withstand impacts to which outdoor signs are typically exposed.

The fiber optic display system of the present invention has an optical system that provides enhanced brightness of the output light. As such, the display system 10 can be used for outdoor signs. Although the fiber optic display system 10 is structurally robust with a simple, low-cost image generator, it is extremely flexible and allows the displayed image and/or view angle to be automatically and/or remotely changed.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator that generates an image received by the first ends of the fiber optics; and an array of lenses for receiving light from the second ends of the fiber optics, the lenses aiming the light from the fiber optics to control the viewing angle of the image displayed.

2. A fiber optic display system as recited in claim 1 wherein said array of lenses includes a sheet of microlenses.

3. A fiber optic display system as recited in claim 1 wherein said array of lenses is movable with respect to the second ends of the fiber optics to vary the viewing angle of the image displayed.

4. A fiber optic display system as recited in claim 3 including at least one motor for moving the array of lenses with respect to the second ends of the fiber optics; at least one position sensor for detecting the position of the array and generating a position signal; and a controller responsive to the position signal for controlling the motor to drive the array to a desired position.

5. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator that generates an image received by the first ends of the fiber optics;

an array of lenses for receiving light from the second ends of the fiber optics, the lenses aiming the light from the fiber optics to control the viewing angle of the image displayed; wherein said array of lenses is movable with respect to the second ends of the fiber optics to vary the viewing angle of the image displayed;

at least one motor for moving the array of lenses with respect to the second ends of the fiber optics;

at least one position sensor for detecting the position of the array and generating a position signal;

a controller responsive to the position signal for controlling the motor to drive the array to a desired position; and a communication interface coupled to the controller to receive array position information from a remote location to allow the position of the array to be remotely controlled.

6. A fiber optic display system as recited in claim 1 wherein each lens of the array is associated with a particular fiber optic.

7. A fiber optic display system as recited in claim 6 including a panel with a plurality of apertures therein, each aperture supporting a lens and second end of a fiber optic therein.

8. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator that generates an image received by the first ends of the fiber optics;

an array of lenses for receiving light from the second ends of the fiber optics, the lenses aiming the light from the fiber optics to control the viewing angle of the image displayed;

a panel with a plurality of apertures therein; and a plurality of mounting members, each mounting member insertable into a respective aperture in the panel, and each mounting member having a first aperture for receiving a second end of a fiber optic, the first aperture leading into a second aperture for receiving a lens associated with the fiber optic, the second aperture being of greater size than the first aperture, with a fixed optical aperture formed between the first and second apertures.

9. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than then spacing between the first ends in the bundle;

an image generator that generates an image received by the first ends of the fiber optic;

an array of lenses for receiving light from the second ends of the fiber optics, the lenses aiming the light from the fiber optics to control the viewing angle of the image displayed; and a panel for supporting the second ends of the fiber optics for displaying the image and for supporting and end of at least one fiber optic for receiving ambient light and coupling the ambient light to a photo detector to detect the intensity of the light.

10. A fiber optic display system as recited in claim 9 wherein the image generator includes a variable intensity light source and a controller responsive to the detected intensity of the ambient light for varying the intensity of the light source.

11. A fiber optic display system as recited in claim 10 wherein the controller increases the intensity of the light source with increasing ambient light.

12. A fiber optic display system as recited in claim 10 wherein the controller decreases the intensity of the light source with decreasing ambient light.

13. A fiber optic display system as recited in claim 10 including a communication interface for coupling information derived from the detected ambient light intensity to the remote location.

14. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator that generates an image received by the first ends of the fiber optics wherein the image generator includes a light source;

a plurality of image bearing transparencies on a movable support;

a motor for moving the support and a controller coupled to the motor for controlling the motor to move the support to position a selected image bearing transparency between the light source and the first ends of the fiber optics for displaying the image on the selected transparency; and an array of lenses for receiving light from the second ends of the fiber optics, the lenses aiming the light from the fiber optics to control the viewing angle of the image displayed.

15. A fiber optic display system as recited in claim 14 including a communication interface coupled to the controller for receiving image selection information to allow the displayed image to be remotely controlled.

16. A fiber optic display system as recited in claim 14 wherein each image bearing transparency has detectable position indicia associated therewith and the fiber optic display system includes a detector for detecting the indicia associated with a particular position of the movable support to generate a signal representative thereof, the controller being responsive to the detected indicia to control the position of the movable support to align a selected image bearing transparency between the light source and the first ends of the fiber optics.

17. A fiber optic display system as recited in claim 1 wherein said image generator includes a light source formed of an array of white light emitting diodes.

18. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator that generates an image received by the first ends of the fiber optics; wherein said image generator includes a light source formed of an array of white light emitting diodes and said light source includes a support with a plurality of interior, white side and bottom walls wherein the light emitting diodes are supported on a plurality of the interior walls;

an array of lenses for receiving light from the second ends of the fiber optics, the lenses aiming the light from the fiber optics to control the viewins4 angle of the image displayed.

19. A fiber optic display system as recited in claim 18 wherein the light sources include a brightness enhancing film through which light from the light emitting diodes pass.

20. A fiber optic display system as recited in claim 18 including a frosted plate through which light from the light emitting diodes pass to produce substantially uniform illumination.

21. A fiber optic display system comprising:

an illumination source formed of an array of white light emitting diodes;

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

image generator disposed between the light source and the first ends of the fiber optics to generate an image received by the first ends of the fiber optics, the image generator including a support with a plurality of image bearing transparencies, the support being movable to position a selected image bearing transparency between the illumination source and the first ends of the fiber optics; and at least one lens for directing the illumination light to a selected image bearing transparency.

22. A fiber optic display system as recited in claim 21 including an array of lenses for receiving light from the second ends of the fiber optics to direct the light output therefrom.

23. A fiber optic display system as recited in claim 22 wherein said array of lenses includes a sheet of microlenses.

24. A fiber optic display system as recited in claim 22 wherein said array of lenses is movable with respect to the second ends of the fiber optics to vary the viewing angle of the image displayed.

25. A fiber optic display system as recited in claim 24 including at least one motor for moving the array of lenses with respect to the second ends of the fiber optics; at least one position sensor for detecting the position of the array and generating a position signal; and a controller responsive to the position signal for controlling the motor to drive the array to a desired position.

26. A fiber optic display system as recited in claim 25 including a communication interface coupled to the controller to receive array position information from a remote location to allow the position of the array to be remotely controlled.

27. A fiber optic display system as recited in claim 22 wherein each lens of the array is associated with a particular fiber optic.

28. A fiber optic display system as recited in claim 27 including a panel with a plurality of apertures therein, each aperture supporting a lens and second end of a fiber optic therein.

29. A fiber optic display system as recited in claim 28 including a mounting member insertable into a respective aperture in the panel, the mounting member having a first aperture for receiving a second end of a fiber optic, the first aperture leading into a second aperture for receiving a lens associated with the fiber optic, the second aperture being of greater size than the first aperture, with a fixed optical aperture formed between the first and second apertures.

30. A fiber optic display system as recited in claim 21 including a panel for supporting the second ends of the fiber optics for displaying the image and for supporting an end of at least one fiber optic for receiving ambient light and coupling the ambient light to a photo detector to detect the intensity of the light.

31. A fiber optic display system as recited in claim 30 including a variable intensity light source and a controller responsive to the detected intensity of the ambient light for varying the intensity of the light source.

32. A fiber optic display system as recited in claim 31 including a communication interface for coupling information derived from the detected ambient light intensity to the remote location.

33. A fiber optic display system as recited in claim 21 including a motor coupled to the movable support and a controller coupled to the motor to automatically move the support to position a selected image bearing transparency between the illumination source and the first ends of the fiber optics.

34. A fiber optic display system as recited in claim 33 including a communication interface coupled to the controller for receiving image selection information to allow the displayed image to be remotely controlled.

35. A fiber optic display system as recited in claim 33 wherein each image bearing transparency has detectable position indicia associated therewith and the fiber optic display system includes a detector for detecting the indicia associated with a particular position of the movable support to generate a signal representative thereof, the controller being responsive to the detected indicia to control the position of the movable support to align a selected image bearing transparency between the light source and the first ends of the fiber optics.

36. A fiber optic display system as recited in claim 21 wherein said light source includes a support with a plurality of interior, white side and bottom walls wherein the light emitting diodes are supported on a plurality of the interior walls.

37. A fiber optic display system as recited in claim 36 wherein the light sources include a brightness enhancing film through which light from the light emitting diodes pass.

38. A fiber optic display system as recited in claim 36 including a frosted plate through which light from the light emitting diodes pass to produce substantially uniform illumination.

39. A fiber optic display system comprising:

an illumination source with a support having a plurality of interior, white side and bottom walls, an array of white light emitting diodes supported on at least one of the interior walls, and an optical element through which the light from the light emitting diodes pass to provide a substantially uniform illumination source;

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle; and an image generator disposed between the light source and the first ends of the fiber optics to generate an image received by the first ends of the fiber optics.

40. A fiber optic display system as recited in claim 39 wherein the illumination source includes an array of white light emitting diodes mounted on a plurality of the walls of the support.

41. A fiber optic display system as recited in claim 39 wherein the light sources include a brightness enhancing film through which light from the light emitting diodes pass.

42. A fiber optic display system as recited in claim 39 including a frosted plate through which light from the light emitting diodes pass to produce substantially uniform illumination.

43. A fiber optic display system as recited in claim 39 wherein the image generator includes a plurality of image bearing transparencies on a movable support; a motor for moving the support and a controller coupled to the motor for controlling the motor to move the support to position a selected image bearing transparency between the light source and the first ends of the fiber optics for displaying the image on the selected transparency.

44. A fiber optic display system as recited in claim 43 including a communication interface coupled to the controller for receiving image selection information to allow the displayed image to be remotely controlled.

45. A fiber optic display system as recited in claim 43 wherein each image bearing transparency has detectable position indicia associated therewith and the fiber optic display system includes a detector for detecting the indicia associated with a particular position of the movable support to generate a signal representative thereof, the controller being responsive to the detected indicia to control the position of the movable support to align a selected image bearing transparency between the light source and the first ends of the fiber optics.

46. A fiber optic display system as recited in claim 39 including an array of lenses for receiving light from the second ends of the fiber optics to direct the light output therefrom.

47. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator for generating a plurality of images, a selected image generated by the image generator being coupled to the first ends of the fiber optic;

an array of lenses for receiving light from the second ends of the fiber optics, the lenses aiming the light from the fiber optics to control the viewing angle of the image displayed, the array being movable to change the viewing angle; and a controller for automatically selecting an image to be generated and displayed and for controlling the position of the array of lenses with respect to the second ends of the fiber optics.

48. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator for generating a plurality of images, a selected image generated by the image operator being coupled to the first ends of the fiber optic;

an array of lenses for receiving light from the second ends of the fiber optics, the lenses aiming the light from the fiber optics to control the viewing angle of the image displayed, the array being movable to change the viewing angle;

a controller for automatically selecting an image to be generated and displayed and for controlling the position of the array of lenses with respect to the second ends of the fiber optics; and a communication interface coupled to the controller to receive data therefrom according to which the controller operates.

49. A fiber optic display system as recited in claim 47 wherein said array of lenses includes a sheet of microlenses.

50. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator for generating a plurality of images, a selected image generated by the image generator being coupled to the first ends of the fiber optic;

an array of lenses for receiving light from the second ends of the fiber optics, the lenses aiming the light from the fiber optics to control the viewing angle of the image displayed, the array being movable to change the viewing angle;

a controller for automatically selecting an image to be generated and displayed and for controlling the position of the array of lenses with respect to the second ends of the fiber optics; and at least one position sensor for detecting the position of the array and generating a signal representative thereof, said controller being responsive to the position signal for controlling the movement of the array.

51. A fiber optic display system comprising:

a plurality of fiber optics having first and second ends, the first ends being arranged in a bundle to receive an image, the fiber optics coupling an image to the second ends thereof for displaying the image wherein the spacing between the second ends of the fiber optics is greater than the spacing between the first ends in the bundle;

an image generator for generating a plurality of images, a selected image generated by the image generator being coupled to the first ends of the fiber optic wherein the image generator includes a light source;

a plurality of image bearing transparencies on a movable support;

a motor for moving the support and a controller coupled to the motor for controlling the motor to move the support to position a selected image bearing, transparency between the light source and the first ends of the fiber optics for displaying the image on the selected transparency;

an array of lenses for receiving light from the second ends of the fiber optics, the lenses aiming the light from the fiber optics to control the viewing angle of the image displayed, the array being movable to change the viewing angle; and a controller for automatically selecting an image to be generated and displayed and for controlling the position of the array of lenses with respect to the second ends of the fiber optics.

52. A fiber optic display system as recited in claim 51 including a communication interface coupled to the controller for receiving image selection information to allow the displayed image to be remotely controlled.

53. A fiber optic display system as recited in claim 51 wherein each image bearing transparency has detectable position indicia associated therewith and the fiber optic display system includes a detector for detecting the indicia associated with a particular position of the movable support to generate a signal representative thereof, the controller being responsive to the detected indicia to control the position of the movable support to align a selected image bearing transparency between the light source and the first ends of the fiber optics.

54. A fiber optic display system as recited in claim 47 wherein said image generator includes a light source formed with an array of white light emitting diodes.

55. A fiber optic display system comprising:

a plurality of fiber optics having first and second ends, the first ends being arranged in a bundle to receive an image, the fiber optics coupling an image to second ends thereof for displaying the image;

a lens associated with the second end of each of the fiber optics;

a panel having a plurality of apertures for supporting a second end of a fiber optic and its associated lens in a respective aperture of the panel; and an image generator that generates an image received by the first ends of the fiber optics.

56. A fiber optic display system comprising:

a plurality of fiber optics having first and second ends, the first ends being arranged in a bundle to receive an image, the fiber optics coupling an image to second ends thereof for displaying the image;

a lens associated with the second end of each of the fiber optics;

a panel having a plurality of apertures for supporting a second end of a fiber optic and its associated lens in a respective aperture of the panel;

a mounting member insertable into a respective aperture in the panel, the mounting member having a first aperture for receiving a second end of a fiber optic, the first aperture leading into a second aperture for receiving a lens associated with the fiber optic, the second aperture being of greater size than the first aperture, with a fixed optical aperture formed between the first and second apertures; and an image generator that generates an image received by the first ends of the fiber optics.

57. A fiber optic display system comprising:

a plurality of fiber optics having first and second ends, the first ends being arranged in a bundle to receive an image, the fiber optics coupling an image to second ends thereof for displaying the image;

a lens associated with the second end of each of the fiber optics;

a panel having a plurality of apertures for supporting a second end of a fiber optic and its associated lens in a respective aperture of the panel wherein said panel includes apertures for supporting an end of at least one fiber optic for receiving ambient light, the fiber coupling the ambient light to a photo detector to detect the intensity of the light; and an image generator that generates an image received by the first ends of the fiber optics.

58. A fiber optic display system as recited in claim 57 wherein said image generator includes a variable intensity light source and a controller responsive to the detected intensity of the ambient light for varying the intensity of the light source.

59. A fiber optic display system as recited in claim 58 wherein the controller increases the intensity of the light source with increasing ambient light.

60. A fiber optic display system as recited in claim 58 wherein the controller decreases the intensity of the light source with decreasing ambient light.

61. A fiber optic display system as recited in claim 58 including a communication interface for coupling information derived from the detected ambient light intensity to the remote location.

62. A fiber optic display system as recited in claim 55 wherein a length of the fiber optics is supported in a polyurethane foam.

63. A fiber optic display system comprising:

a variable intensity light source;

a plurality of fiber optics having first and second ends, the first ends being arranged in a bundle to receive an image, the fiber optics coupling an image to second ends thereof for displaying the image;

an image generator disposed between the light source and the first ends of the fiber optics to generate an image received by the first ends of the fiber optics;

a panel having a plurality of apertures for supporting the second ends of the fiber optics to which the image is coupled and for supporting at least one end of a fiber optic that receives ambient light;

a photo detector coupled to the fiber optic that receives ambient light to detect the intensity of the ambient light and generate a signal representative thereof; and a controller responsive to the signal representing the intensity of the ambient light for varying the intensity of the light source.

64. A fiber optic display system comprising:

a plurality of fiber optics having first and second ends, the first ends being arranged in a bundle to receive an image, the fiber optics coupling an image to second ends thereof for displaying the image;

an image generator that generates an image received by the first ends of the fiber optics;

a panel having a plurality of apertures for supporting the second ends of the fiber optics to which the image is coupled and for supporting at least one end of a fiber optic that receives ambient light;

a photo detector coupled to the fiber optic that receives ambient light to detect the intensity of the ambient light and generate a signal representative thereof;

a controller responsive to the signal representing the intensity of the ambient light for generating status information regarding the fiber optic display; and a communication interface coupled to the controller to send the status information to a remote location.

* * * * *